United States Patent [19]

Lawrence

[11] 4,186,467

[45] Feb. 5, 1980

[54] WELDED THERMOPLASTIC STRINGER FOR SLIDE FASTENER AND METHOD OF MANUFACTURE

[75] Inventor: Charles T. Lawrence, Saegertown, Pa.

[73] Assignee: Textron, Inc., Providence, R.I.

[21] Appl. No.: 826,543

[22] Filed: Aug. 22, 1977

[51] Int. Cl.[2] ..... A44B 19/04

[52] U.S. Cl. ..... 24/205.16 R

[58] Field of Search ..... 24/205.16 R, 205.16 C

[56] References Cited

U.S. PATENT DOCUMENTS

| | | | |
|---|---|---|---|
| 2,368,911 | 2/1945 | Andler | 24/205.16 R |
| 3,928,098 | 12/1975 | Moertel | 24/205.16 R |
| 4,033,014 | 7/1977 | Manning | 24/205.16 R |

*Primary Examiner*—Kenneth Dorner

*Attorney, Agent, or Firm*—O'Brien & Marks

[57] ABSTRACT

Heels of leg portions of thermoplastic coupling elements are welded to the opposite sides of a polymer film tape leaving an edge portion of the tape between diverging inside surfaces of the leg portions spaced from the welds.

8 Claims, 6 Drawing Figures

WELDED THERMOPLASTIC STRINGER FOR SLIDE FASTENER AND METHOD OF MANUFACTURE

BACKGROUND OF THE INVENTION

1. Field of the Invention

This invention relates to stringers for slide fasteners and their methods of manufacture, and particularly to stringers employing molded thermoplastic coupling elements attached to polymer tapes.

2. Description of the Prior Art

The prior art as exemplified in U.S. Pat. Nos. 3,414,948; 3,490,111; 3,691,599 and 3,928,098 contains a number of slide fasteners having coupling elements attached to the edge of textile tapes. Some of the prior art such as is shown in the U.S. Pat. No. 3,928,098 disclose alternate U-shaped heel members of a filamentary stringer welded to opposite sides of a tape which is a woven or a nonwoven type with fibers. The textile tapes employed in the prior art provide support and maintain the spacing of coupling elements attached thereto. Tapes formed of polymer film having two laminated layers of highly oriented polymer wherein the orientations in the two layers are both oblique to the tape and transverse to each other have been previously proposed for use in slide fasteners; however these proposed slide fasteners utilize either (1) stitching to secure the elements to the polymer film tape which may be folded or (2) folded film tapes with continuous coupling elements inserted inside the fold with head portions protruding through slots extending transversely over the folded edge. Welding of coupling elements to such polymer tapes would generally result in inferior slide fasteners since the molecular orientation and increased strength along the direction of molecular orientations is deteriorated by the welding and the elements would easily be pulled from the tape by the forces on the slide fasteners.

SUMMARY OF THE INVENTION

The invention is summarized in a stringer for a slide fastener including a tape of polymer film material, a train of thermoplastic coupling elements each including a head portion and a pair of leg portions extending in generally the same direction from opposite sides of the head portion, each pair of the leg portions extending over respective opposite sides of the tape at one longitudinal edge of the tape, the leg portions terminating in heel portions which are joined by welds to the opposite sides of the tape, the leg portions of each coupling element having respective inside surfaces which diverge from the welds toward the opposite sides of the head portion, and the tape having a longitudinal portion at its one edge between the diverging inside surfaces of the leg portions spaced from the welds.

An object of the invention is to construct a relatively strong and durable stringer for a slide fastener utilizing polymer coupling elements welded on a polymer film tape.

Another object of the invention is to prevent the tearing of coupling elements from the edge of a polymer film tape.

It is also an object of the invention to utilize diverging inside surfaces of the legs of coupling elements in welding heel portions of the legs to a tape so that an inner edge of the tape is invested in the elements.

One advantage of the invention is that an inner edge of the tape between the leg portions spaced from the welds of heels of the coupling element to the tape remains unaffected by the welds and maintains its strength.

One feature of the invention concerns a longitudinally folded polymer tape with oblique molecular orientation passing over the folded edge invested within coupling elements to provide improved strength in the stringer.

Another feature of the invention contemplates cords running parallel to the tape and embedded within the respective legs of the coupling elements welded on a polymer tape to substantially reinforce the stringer.

Other objects, advantages and features of the invention will be apparent from the following description of the preferred embodiment taken in conjunction with the accompanying drawings.

DESCRIPTION OF THE PREFERRED EMBODIMENT

Figure 1:
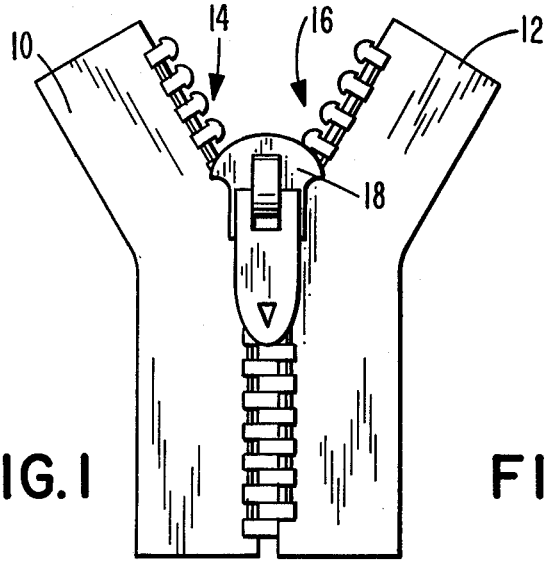
FIG. 1 is a plan view of a slide fastener constructed in accordance with the invention.

As illustrated in FIG. 1, a slide fastener manufactured in accordance with the invention includes a pair of carrier or support tapes 10 and 12 having rows of spaced interlocking coupling elements 14 and 16 attached to the respective inner edges thereof. A slider 18 is slidably mounted on the rows of coupling elements 14 and 16 for opening and closing the slide fastener in a conventional manner. The tape 10 and coupling elements 14 form a left stringer while the tape 10 and coupling elements 16 form a ring stringer as viewed in FIG. 1. Together the left and right stringers form a slide fastener chain. The left stringer is a mirror image of the right stringer; thus for the sake of brevity only the left stringer is described in detail.

Figure 2:
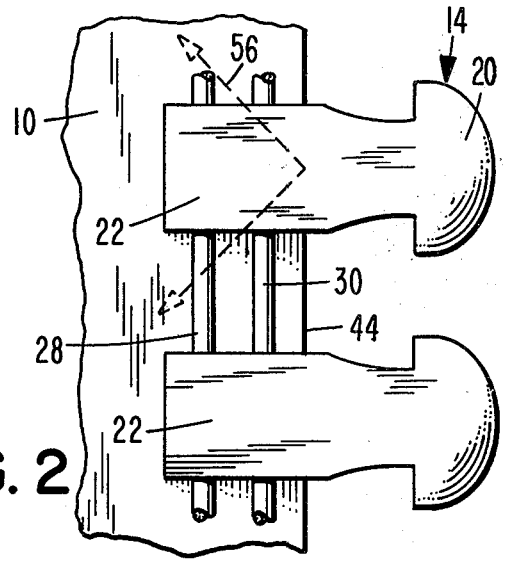
FIG. 2 is an enlarged plan view of a broken away portion of one stringer of the slide fastener of FIG. 1.
Figure 3:
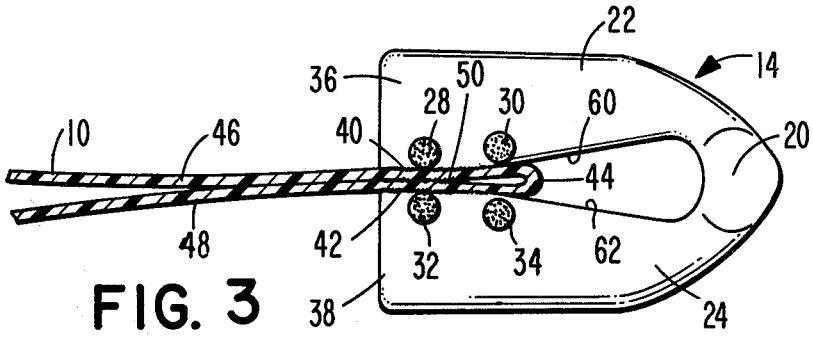
FIG. 3 is a cross section view of the stringer portion of FIG. 2.

As shown in FIGS. 2 and 3 the coupling elements 14 are formed from a molded thermoplastic, and each element has a head portion 20 and leg portions 22 and 24 extending in generally the same direction from opposite sides of the head portion over the respective opposite sides of the tape 10. Connecting thread means, such as spaced parallel textile threads 28, 30, 32 and 34, extend parallel to the tape 10; the threads 28 and 30 being on the upper side of the tape 10 and having segments embedded within the leg portions 22 with connecting segments of the threads 28 and 30 extending between legs 22 of the coupling elements 14, and the threads 32 and 34 being on the bottom side of the tape 10 and having segments embedded within the leg portions 24 with connecting segments of the threads 32 and 34 extending between the legs 24 of the coupling elements 20. The legs 22 and 24 terminate in respective heel portions 36 and 38 which are secured to the opposite sides of the tape 10 by respective welds 40 and 42. The threads 28, 30, 32 and 34 are located adjacent the inside surfaces of the leg portions 22 and 24 with the threads 28 and 32 adjacent the heels 36 and 38 as well as the welds 40 and 42.

Figure 6:
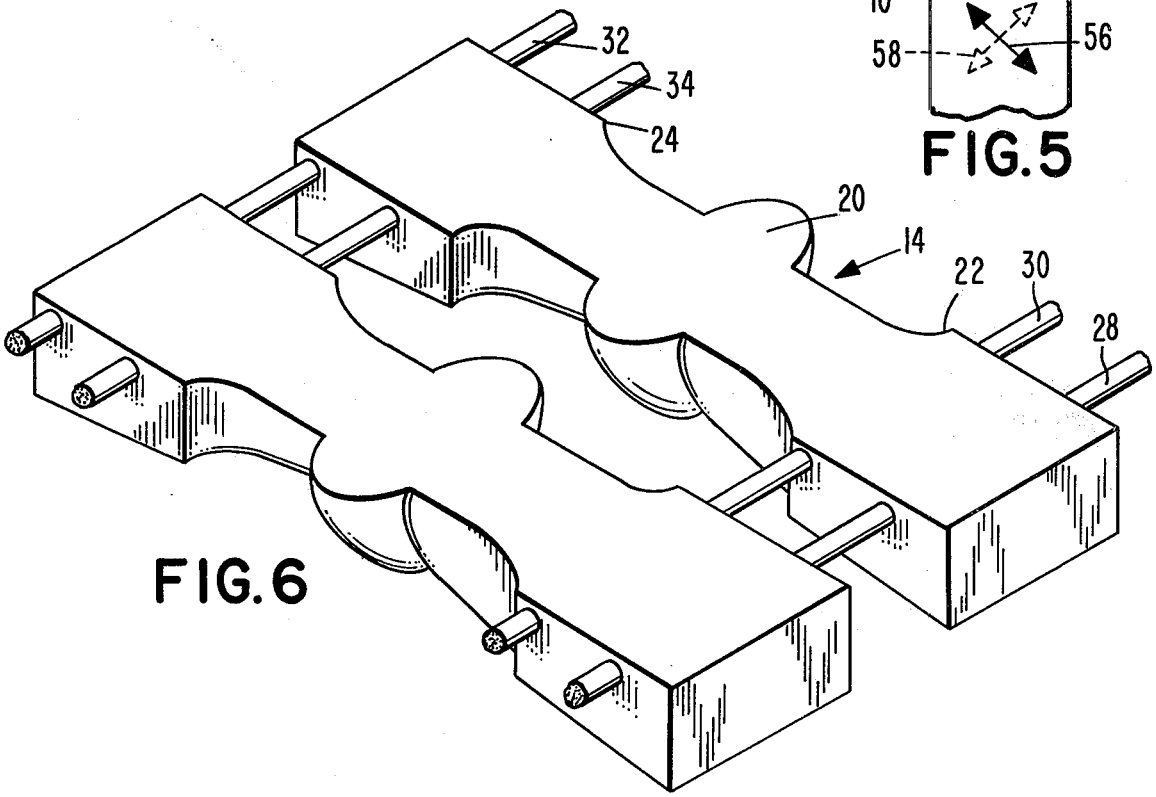
FIG. 6 is a perspective view of a portion of a train of coupling elements employed in the slide fastener of FIG. 1 prior to folding and attaching to the inner edge of a tape.

As shown in FIG. 6 the train of coupling elements 14 connected by connecting textile threads 28, 30, 32 and 34 is initially formed or molded in a flat condition by conventional apparatus or techniques. Such a conventional apparatus generally includes a cavity wheel having cavities around its periphery conforming to the shape of the coupling elements 14 with annular grooves for directing the connecting threads across the cavities together with injection means for injecting polymer into the cavities to form the coupling elements 14. After molding, the coupling elements 14 are folded into a U-shape as shown in FIG. 3 and then welded to the opposite sides of the tape 10 such as by the application of ultrasonic energy.

Figure 4:
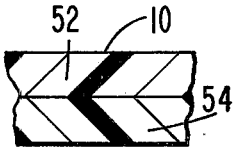
FIG. 4 is an enlarged cross section view of a broken away portion of a film tape employed in the slide fastener of FIGS. 1–3.
Figure 5:
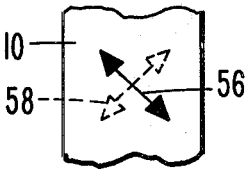
FIG. 5 is a plan view of the tape portion of FIG. 4.

The tape 10 is formed from a thermoplastic or polymer film which is folded at its inner edge 44 to form folded halves or overlying portions 46 and 48 extending between the leg portions 22 and 24. Where the heels 36 and 38 are welded at welds 40 and 42 to the outside surfaces of the tape portions 46 and 48, the tape portions 46 and 48 are welded together by welds 50. The film forming the tape 10 in FIG. 3 in each of the folded halves 46 and 48 is illustrated as being a single thickness; however, as shown in FIG. 4, the film 10 in each of the halves 46 and 48 is formed from a pair of laminated layers 52 and 54 of highly oriented polymer film which have respective molecular orientations extending in crossing directions shown by arrows 56 and 58 in FIG. 5. The orientations of the layers 52 and 54 are both transverse to the longitudinal dimension of the tape 10 and are also transverse to each other. For example the directions 56 and 58 are illustrated as being at 45° angles to the tape 10 and at 90° angles with respect to each other. Such a polymer film is commercially available in an oriented high density polyethylene laminated film sold under the trademark VALERON by Van Leer Plastics Inc. Other oriented films such as non-folded films having layers of crossing molecular orientations oblique to the longitudinal dimension of the tape and folded films having a single layer with a molecular orientation oblique to the longitudinal dimension of the tape can be employed; in the latter type of film of a single oblique orientation, the orientations of the folded halves will cross each other in the manner that the orientations 56 and 58 cross.

Inside surfaces 60 and 62 of the respective leg portions 22 and 24 diverge from the heel portions 36 and 38 to the head portions 20. The inner edge 44 of the tape 10 extends between the diverging surfaces 60 and 62 and is spaced from the welds 40 and 42 to be positioned intermediate the heel portions 36 and 38 and the head portions 20 and to thus maintain the edge 44 and a portion of the tape adjacent to the edge 44 spaced from and unaffected by the welds 40 and 42. Also between the coupling elements 14, there is an absence of any welds 40, 42 or 50. During welding, the polymer in the tape tends to become disoriented and restructured thus weakening the film 10 at the point of the weld. By having a portion of the tape 44 extending between the diverging surfaces 60 and 62 invested between the leg portions 22 and 24 and unaffected by the welds and by having this invested portion connected to the rest of the tape by unwelded tape portions between coupling elements, the strength of attachment of the coupling elements 14 to the tape 10 is increased compared to elements which are welded on the edge of a tape without any invested portions so connected.

Using a polymer film tape with a high degree of molecular orientation which extends transverse to the tape 10 increases the dimensional stability of the slide fastener. In the directions of molecular orientation 56 and 58 of the respective film layers 52 and 54, such layers have substantially increased tensile strength compared to directions not parallel to the molecular orientation or compared to non-oriented films of similar material. Having at least one molecular orientation at an oblique angle in the folded tape 10 (see 56 in FIG. 2) results in lines of orientation and high tensile strength extending obliquely from both before and behind the elements 14 into the edge portions 44 invested between the legs 22 and 24 without passing through the areas of welds 40, 42 and 50. Similarly, unfolded tapes having multiple layers with crossing orientations in the multiple layers oblique to the tape result in lines of increased tensile strength extending obliquely from both before and behind the elements into the invested edge portions of the tape. By employing a tape with lines of molecular orientation extending obliquely from both before and behind the elements into invested portions of the tape, a substantial increase in the strength of attachment of the elements to the tape is produced since the invested portions of the tape between the legs of the coupling elements are connected by lines of increased tensile strength to the remaining portions of the tape.

Also, employing coupling elements molded on connecting threads 28, 30, 32 and 34 results in the textile threads 28, 30, 32 and 34 extending along the inner edge of the tape 10 to substantially reinforce such inner edge where the forces between the coupling elements is the greatest. Conventional textile threads are very stable in their longitudinal direction; this maintains the dimensional stability of the coupling elements 14 to prevent stretching of the polymer film tape 10 which would result in increasing the spacing between the coupling elements to reduce the coupling strength and/or prevent effective coupling of the elements 14 with the elements 16 of FIG. 1.

Since the invention is subject to many variations, modifications and changes in detail, it is intended that all matter in the foregoing description and shown in the accompanying drawings be interpreted as illustrative and not in a limiting sense.

What is claimed is:

1. A stringer for a slide fastener comprising a tape of longitudinally folded polymer film material forming respective overlying folded portions, a train of thermoplastic coupling elements each including a head portion and a pair of leg portions extending in generally the same direction from opposite sides of the head portion, each pair of said leg portions extending over the respective folded portions on opposite sides of the tape at one longitudinal edge of the tape, said leg portions terminating in heel portions which are joined by welds to the respective folded portions of the tape, said folded portions being joined together by welds therebetween at the locations of the welds between the heel portions and the tape, said leg portions of each coupling element having respective inside surfaces which diverge from the welds toward the opposite sides of the head portion, said tape having a longitudinal portion at its one longitudinal edge between the diverging inside surfaces of the leg portions spaced from the welds and having portions between adjacent coupling elements free of the welds, said polymer film including a layer of polymer having a high degree of molecular orientation extending transversely to the tape so that lines of molecular orientation in the film extend continuously across the tape between adjacent coupling elements through the longitudinal portion to the one longitudinal edge.

2. A stringer for a slide fastener as claimed in claim 1 wherein the polymer film material includes a second layer of polymer having a high degree of molecular orientation which extends in a direction transverse to the direction of the molecular orientation in the first layer of polymer.

3. A stringer for a slide fastener as claimed in claim 2 wherein the orientation of the polymer in each of the pair of layers also extends at an oblique angle to the longitudinal dimension of the tape.

4. A stringer for a slide fastener as claimed in claim 1 wherein the one longitudinal edge of the tape is the folded edge of the tape which extends between the leg portions.

5. A stringer for a slide fastener as claimed in claim 4 wherein the molecular orientation of the layer of polymer extends at an oblique angle to the longitudinal dimension of the tape so that lines of molecular orientation in the film extend continuously from one side of each respective element through the one folded longitudinal edge portion between the leg portions of each respective element to the opposite side of each respective element.

6. A stringer for a slide fastener comprising a tape of folded polymer film having overlying folded portions, a train of thermoplastic coupling elements each including a head portion and a pair of leg portions extending in generally the same direction from opposite sides of the head portion with connecting thread means joining the coupling elements together, said leg portions extending over the outside surfaces of both folded portions at one edge of the tape, said leg portions terminating in heel portions which are joined by welds to the respective folded portions of the tape, said folded portions of the tape also being joined together by welds at the locations where the folded portions are joined to the heel portions, said tape having longitudinal portions of the respective folded portions at the one edge of the tape extending between the leg portions and being free of the welds, said tape further having portions of the respective folded portions extending between the coupling elements and being free of the welds, and said polymer film including a layer with a high degree of molecular orientation transverse to the longitudinal dimension of the tape.

7. A stringer for a slide fastener as claimed in claim 6 wherein the connecting thread means includes four parallel spaced threads, two of said four threads being embedded in each leg portion of each pair of leg portions.

8. A stringer for a slide fastener as claimed in claim 6 wherein the film includes a pair of laminated layers of polymer which have orientations extending at oblique angles to the longitudinal dimension of the tape and transverse to each other.

* * * * *